US008209931B2

(12) United States Patent
Sareyka

(10) Patent No.: US 8,209,931 B2
(45) Date of Patent: Jul. 3, 2012

(54) SEISMIC CEILING SUPPORT

(75) Inventor: Brett W. Sareyka, Aston, PA (US)

(73) Assignee: Worthington Armstrong Venture, Malvern, PA (US)

( * ) Notice: Subject to any disclaimer, the term of this patent is extended or adjusted under 35 U.S.C. 154(b) by 70 days.

(21) Appl. No.: 12/806,769

(22) Filed: Aug. 21, 2010

(65) Prior Publication Data

US 2012/0042584 A1 Feb. 23, 2012

(51) Int. Cl.
*E04B 9/00* (2006.01)

(52) U.S. Cl. ..... 52/506.06; 52/506.07; 52/506.08; 52/220.6

(58) Field of Classification Search ..... 52/506.5, 52/506.06, 506.01, 506.07, 509, 512, 167.1, 52/713, 665, 712, 714, 715, 716.1, 717.03, 52/506.08, 220.6, 289; 403/191, 233, 235, 403/346, 230, 241, 347, 382, 247, 403, 405.1
See application file for complete search history.

(56) References Cited

U.S. PATENT DOCUMENTS 3,084,401 A * 4/1963 Findlay ..... 52/476
3,798,865 A 3/1974 Curtis
4,364,215 A 12/1982 Gailey et al.
4,610,562 A 9/1986 Dunn
4,715,161 A * 12/1987 Carraro et al. ..... 52/714
4,794,745 A 1/1989 Platt et al.
4,827,681 A 5/1989 Platt
5,046,294 A * 9/1991 Platt ..... 52/506.06
5,937,605 A * 8/1999 Wendt ..... 52/506.06
7,278,243 B2 10/2007 Jones et al.
7,293,393 B2 11/2007 Kelly et al.
7,552,567 B2 * 6/2009 Ingratta et al. ..... 52/506.07
7,578,107 B2 * 8/2009 Platt ..... 52/506.06

FOREIGN PATENT DOCUMENTS

EP 37061 A1 * 10/1981

OTHER PUBLICATIONS

News Release MEMO from National Rolling Mills, Inc., U.S.A., dated Sep. 1, 1991.

* cited by examiner

*Primary Examiner* — Brian Glessner
*Assistant Examiner* — Adam Barlow
(74) *Attorney, Agent, or Firm* — Eugene Chovanes

(57) ABSTRACT

In a panel suspended ceiling for seismic prone areas, a superstructure extends from and above the ceiling grid. The superstructure is engaged within a lateral support bar that slidably supports the superstructure, and ceiling, during a seismic event.

4 Claims, 8 Drawing Sheets

FIG.4
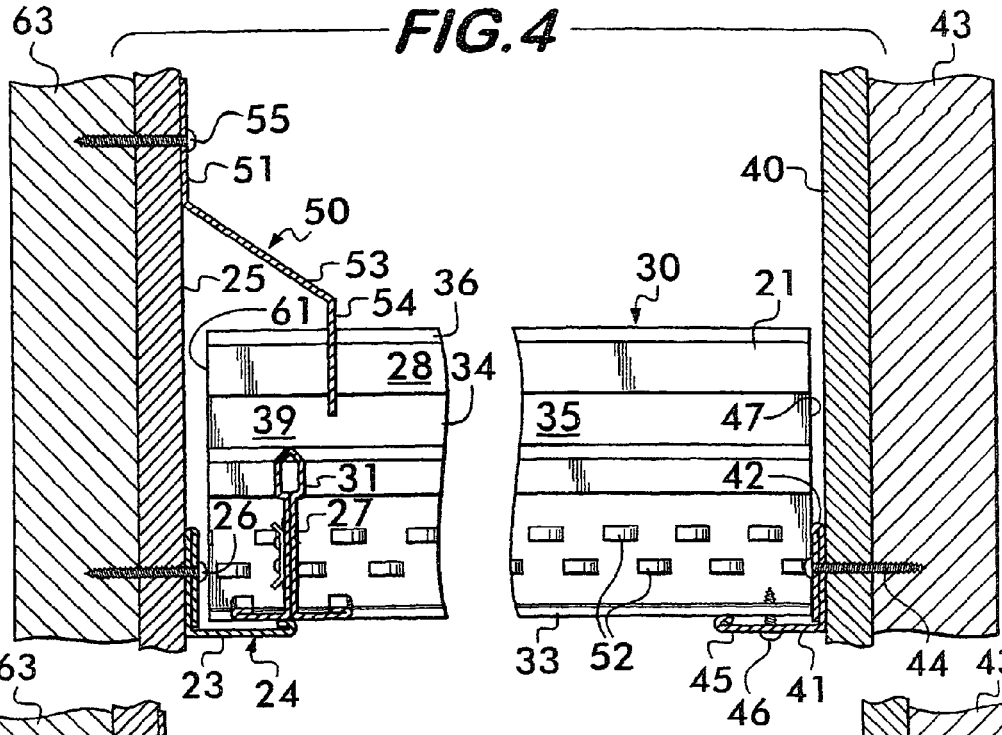
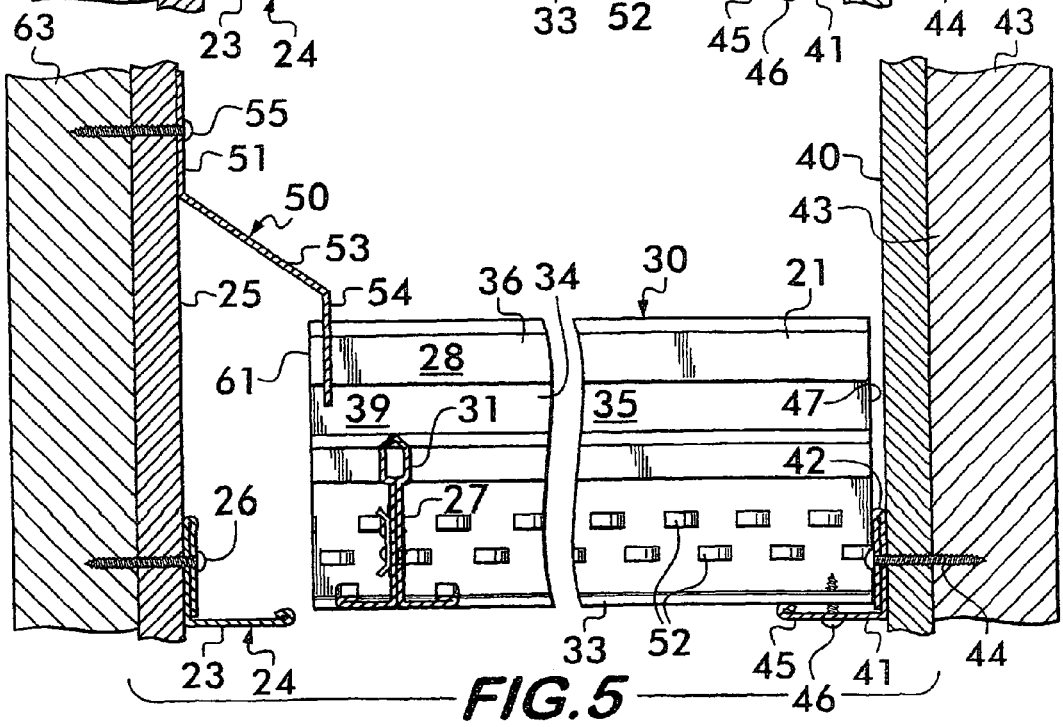
FIG.5

SEISMIC CEILING SUPPORT

BACKGROUND OF THE INVENTION

1. Field of the Invention

The invention relates to suspended ceilings having a grid of metal beams that support panels in grid openings, that are adapted for use in seismic prone areas. The ceiling of the invention is designed to remain intact during a seismic event.

2. Prior Art

Generally, in suspended ceilings, a grid of interconnected metal beams is supported by hang wires embedded in an upper structural ceiling. The beams of the grid extend from wall to wall, and at the wall ends, the beams are supported from a wall molding. The grid supports panels and lights in the grid openings. Such a ceiling is shown in U.S. Pat. No. 4,827,681, incorporated herein by reference.

In some areas of a building, such as hospital corridors, that are often up to twelve feet between walls, hang wires are generally not used in the space between the suspended ceiling and the structural ceiling. The hang wires interfere with structures that necessarily occupy such space, such as water lines, heating and cooling air ducts, electrical conduits, sprinkler systems, communication lines, and conduits for diagnostic systems. When it is absolutely necessary to use hang wires in such space to straddle structures, they are sometimes arranged with trapeze-like installations that are time-consuming to construct, and tend to further clutter the space, which is already congested.

In earthquake prone areas, a conventional way of supporting suspended ceilings up to eight feet in length in a corridor, and sometimes up to twelve feet, with a minimum of hang wires, is to secure the main beams at one end of the grid to a supporting wall designated a fixed wall, vertically and horizontally, by means of a wall molding. At the other end of the main beams, each beam simply rests on the horizontal ledge of an angle molding secured to a wall designated a slip wall, as disclosed, for instance, in U.S. Pat. No. 7,293,393, incorporated herein by reference. The horizontal ledge may be extended up to a two inch width.

In some instances, a perimeter clip is used to secure the ends of the beams to the wall molding. Such a clip is shown in U.S. Pat. No. 5,046,294, incorporated herein by reference. Such a perimeter clip is fixed on the wall molding at each end of a line of beams, and an end of a beam at the end of a line is fixed in a clip.

A hang wire is attached to the beam and to the structural ceiling a short distance inward from the slip wall. In a seismic event, if the beam is shaken off the ledge of the wall molding on the slip wall, the hang wire provides continued support.

BRIEF SUMMARY OF THE INVENTION

The present invention provides additional support, during a seismic event, for suspended ceilings up to twelve feet wide, as described above, particularly for a hospital corridor, where it is desirable to keep space above the suspended ceiling clear of hang wires.

A superstructure of multiple elements of upper bulbs at the top of upper webs is formed above, and extends from, the main beams of a conventional grid in a suspended ceiling. At one end of the superstructure, the elements are slidably keyed into keyhole openings in a fixed lateral support bar. The bar overhangs the beams at what is designated herein as a slip wall, since the grid slips relative to that wall in a seismic event, on one side of the ceiling.

The opposite end of the superstructure is tied to the opposite wall, designated herein as a fixed wall, since the grid is fixed to that wall, and moves with the wall during a seismic event.

In a seismic event, the lateral support bar, and the superstructure, at the slip wall, act as a backup support to the conventional wall molding on which the ends of the main beams normally rest. If the beam ends are shaken off the horizontal ledge of the wall molding on the slip wall during such seismic event, the spaced keyholes in the lateral support bar, each of which slidably receives a bulb and web portion element of the superstructure, at the slip wall, provide continued support for the ceiling.

BRIEF DESCRIPTION OF SEVERAL VIEWS OF THE DRAWING

FIG. 4 is a partial sectional view taken on the line 4-4 of FIG. 3, showing the ceiling during a seismic event, when the opposing walls are closest together.

FIG. 5 is a view similar to FIG. 4 showing the walls when they are furthermost apart during a seismic event.

DETAILED DESCRIPTION OF THE INVENTION

Prior Art Suspended Panel Ceilings

Figure 3:
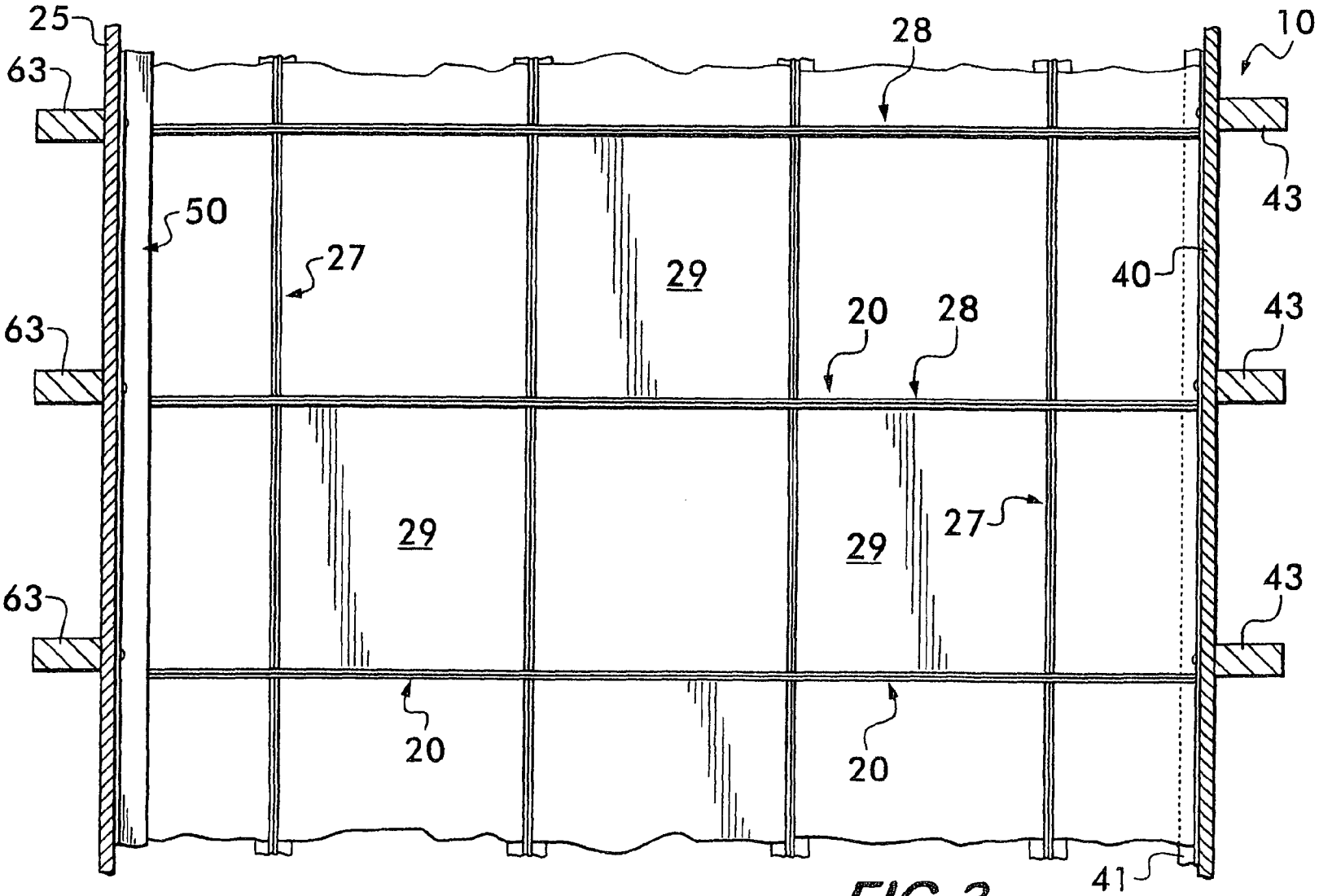
FIG. 3 is a partial plan view, looking downward, of the ceiling of the invention.
Figure 6:
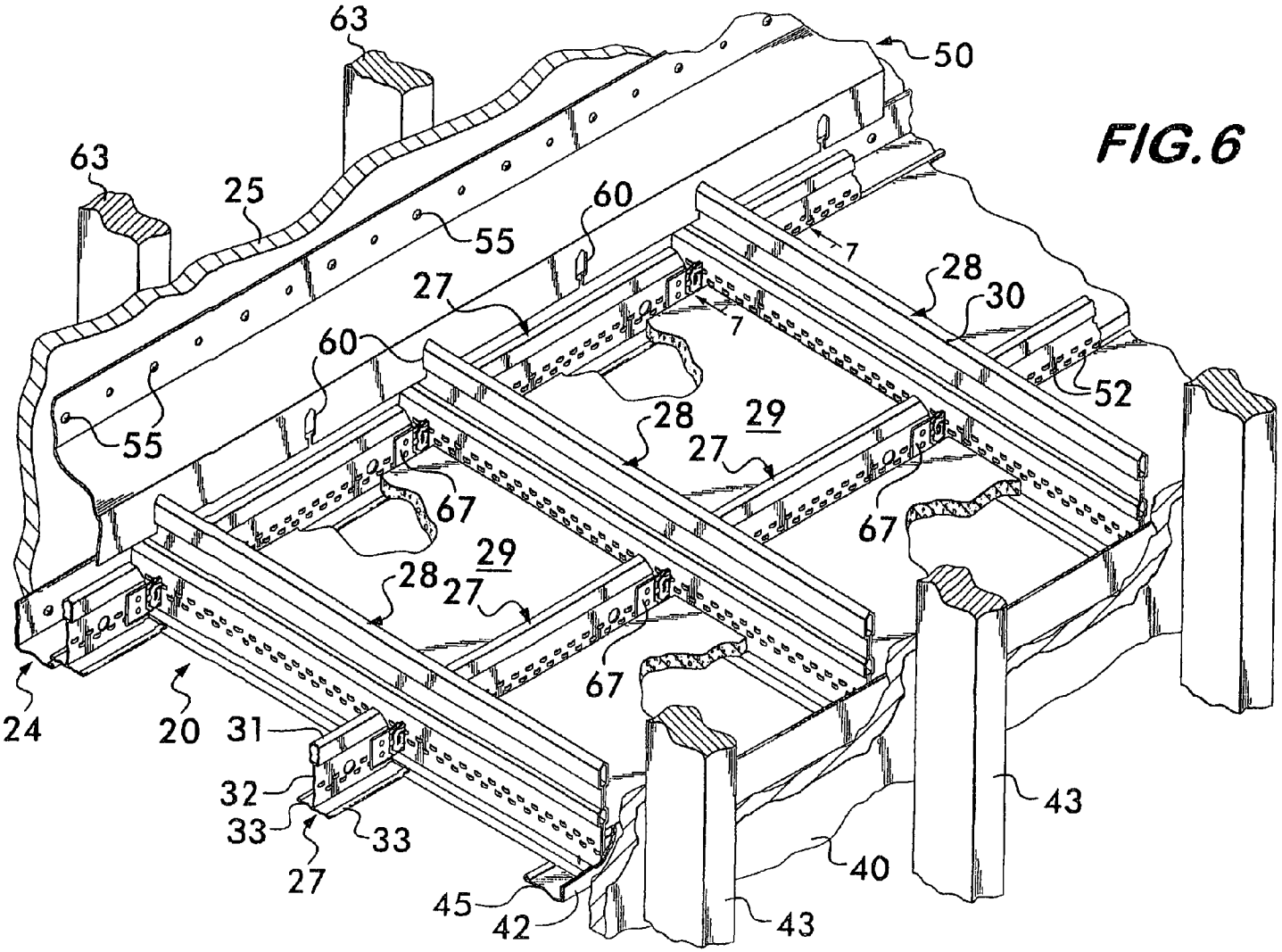
FIG. 6 is a perspective view, taken from above, of a section of the suspended panel ceiling of the invention, extending between a slip wall and a fixed wall, during a quiet time, with portions of the ceiling broken away.

In a suspended panel ceiling 10, as seen, for instance, in FIGS. 3 and 6, grid 20 that supports the panels 29 is formed of main beams 28 and intersecting cross beams 27, that are secured together by connector 67 as disclosed in the below cited U.S. patents. The beams 27 and 28 are of standard uniform height and rollformed of a strip of metal into a cross section having a bulb 31 at the stop, a downwardly extending web 32, and side extending flanges 33. Layers of web 32 are secured together by stitches 52. The panels 29 rest on the flanges 33 in grid openings 70.

Such suspended panel ceilings 10 are shown, for instance, in U.S. Pat. Nos. 4,794,745 and 4,827,681, incorporated herein by reference. The grid 20 is supported from a structural ceiling by hang wires. The ends of the beams 27 and 28 at the perimeter of the grid 20 rest on wall moldings 24 and 41 attached to the side walls.

Prior Art Suspended Panel Ceilings in Seismic Prone Areas

In seismic prone areas, in the prior art, the ends of the main beams 28 in a grid 20 are secured at one side of grid 20 to fixed wall 40, so named because the beam ends 21 in grid 20 are fixed to such wall 40. At the opposite side of grid 20, as seen in FIG. 2, the main beam 28 ends 61 in grid 20 rest on a wall molding 24 secured by screws 64 to studs 63 and slip wall 25, so named because the beam ends 61 in grid 20 slip with respect to the slip wall 25 during a seismic event.

Figure 2:
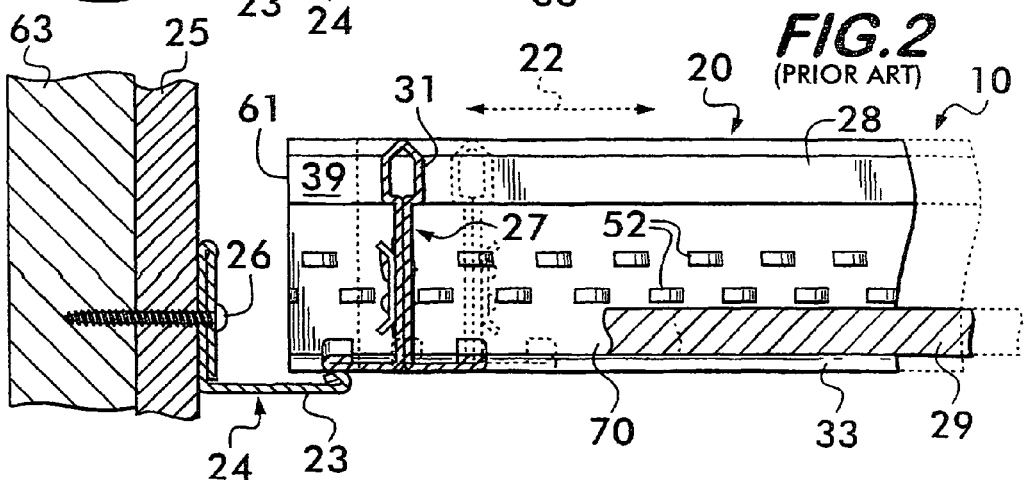
FIG.2 (PRIOR ART)
FIG. 2 is a view similar to FIG. 1, showing the prior art.

In a prior art suspended panel ceiling, as disclosed in the above cited U.S. Patent '393, grid 20, at end 61, during a seismic event as shown in FIG. 2, slips back and forth as indicated by arrow 22 while being supported on the horizontal ledge 23 of an angle wall molding 24, which is secured to a slip wall 25 by screws 26 that pass through the slip wall 25 into support studs 63. In grid 20, cross beams 27 extend normally to main beams 28 to form grid openings 70 that support panels 29, all in the well-known prior art manner.

The Superstructure of the Invention

A superstructure 30 is added above the conventional grid 20 of ceiling 10 described above.

Figure 7:
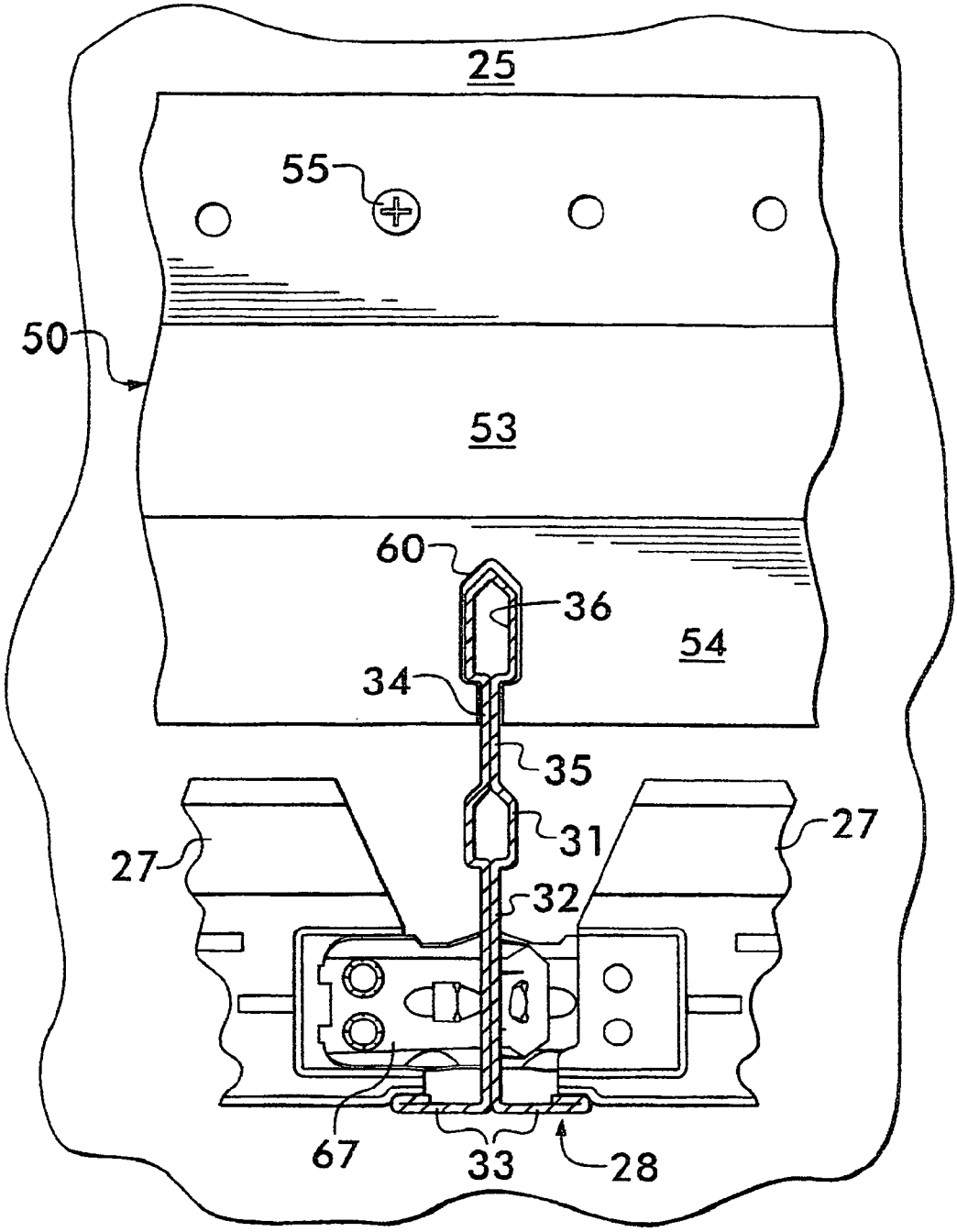
FIG. 7 is an end section taken on the line 7-7 in FIG. 6, showing an element of the superstructure, formed integrally with a main beam, engaged in a keyhole of the lateral support bar.
Figure 8:
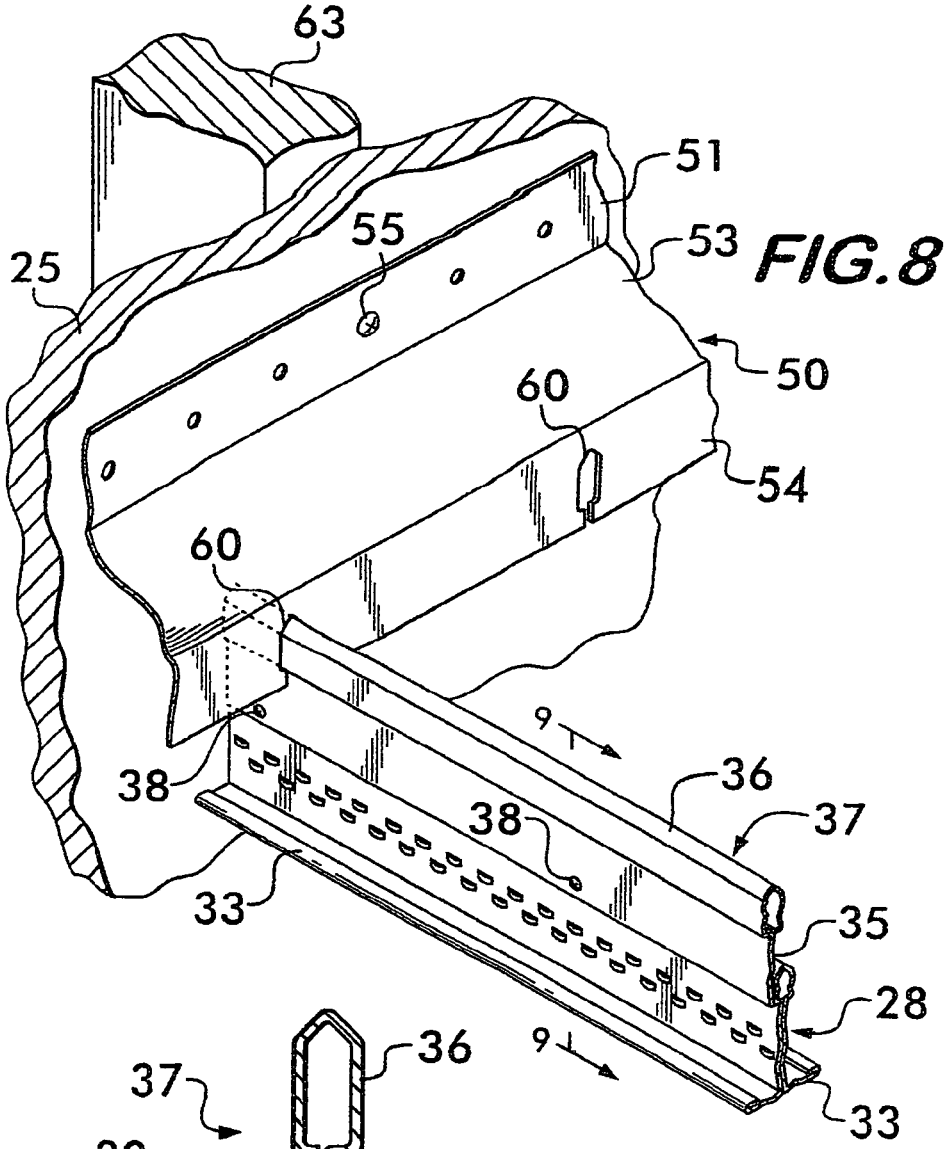
FIG. 8 is a perspective view of a main beam having an element of the superstructure attached to the main beam by screws.
Figure 9:
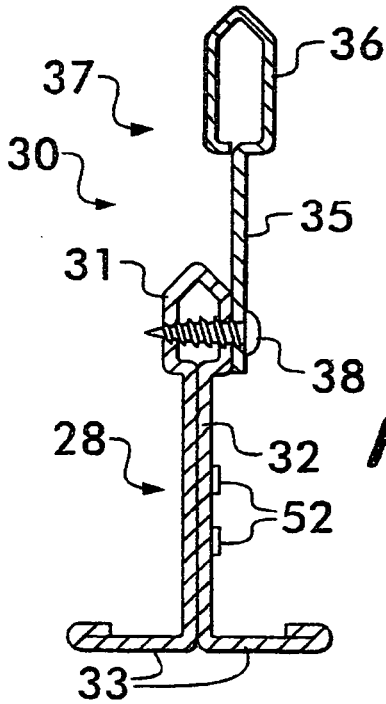
FIG. 9 is an elevational sectional view taken on the line 9-9 of FIG. 8.

The superstructure 30 may be integral with the main beams 28 as shown, for instance, in FIG. 7, or may be separate, but attached to the main beams 28, as shown in FIG. 9.

Superstructure Integral with Prior Art Main Beams

In FIG. 7, there is shown a prior art main beam 28 having a bulb 31, a web 32 depending from the bulb 31, and flanges 33 extending horizontally at the bottom of the web 32. Extending integrally upward from each beam 28 is an element 34 of the superstructure 30. Each element 34 has an upper web 35, and an upper bulb 36 at the top of the upper web 35. Each prior art main beam 28 and the element 34 of the superstructure 30 integral with main beam 28 are all rollformed together from a single piece of metal.

Superstructure Separate But Attached to Main Beams

In FIG. 9, prior art main beam 28 has attached thereto a separately formed element 37 of the superstructure 30 having the upper web 35 and the upper bulb 36 attached to bulb 31 of prior art main beam 28 by screws 38.

Function of Superstructure

The function of the superstructure 30 is to support the suspended panel ceiling 10, if necessary, during a seismic event, from a fixed wall 40 and a slip wall 25.

With either the integral form of superstructure 30 as seen in FIG. 7 or separate, but attached, form of the superstructure 30, as seen in FIG. 9, the function of the superstructure 30 is the same.

Superstructure at Fixed Wall

Each of the multiple, parallel extending, prior art main beams 28 in grid 20 are modified as described below, to connect to superstructure 30 of the invention. The superstructure 30, at ends 47 of main beams 28 in grid 20, is secured to the fixed wall 40 as seen in FIGS. 4 and 5 by an angle wall molding 41. The vertical leg 42 of the molding 41 is secured to a fixed wall 40 and a fixed wall stud 43 by screws 44. In turn, the flanges 33 of the main beams 28 are secured to the horizontal ledge 45 of the molding 41 at the fixed wall 40 by screws 46. In this manner, the main beams 28 of grid 20, and superstructure 30, extending integrally above main beams 28, are secured to the fixed wall 40 vertically and horizontally.

Superstructure at Slip Wall

There extends over the superstructure 30 at the slip wall 25 a lateral support bar 50. Lateral support bar 50 is secured to slip wall 25 at studs 63, by screws 55.

Lateral support bar 50 has an upper vertical segment 51 attached to the slip wall 25, and stud 63 by screws 55, a diagonally downwardly extending segment 53, and a vertical downwardly extending segment 54 with spaced keyholes 60 that receive each of the elements 34 of superstructure 30. The profile of a keyhole 60 conforms to the cross section of the upper bulb 36 and a segment of the upper web 35, with sufficient clearance to allow the element 34 of superstructure 30 to slide within keyhole 60, while maintaining support of the element 34. The lateral support bar 50, through keyholes 60, maintains a level of support for superstructure 30 wherein there is no interference between flanges 33 and horizontal ledge 23 of angle wall molding 24 as beam 28 moves off and onto wall molding 24 during a seismic event.

Figure 11:
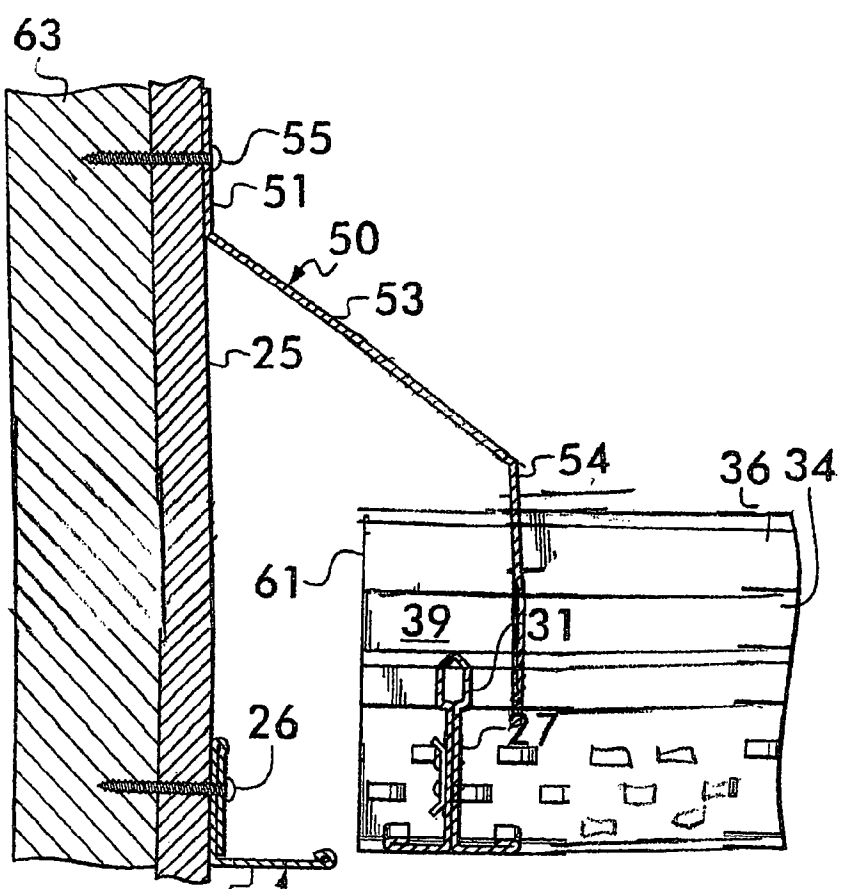
FIG. 11 is a view similar to FIG. 5, showing the structure of FIG. 10 when the walls are furthermost apart during a seismic event.
Figure 10:
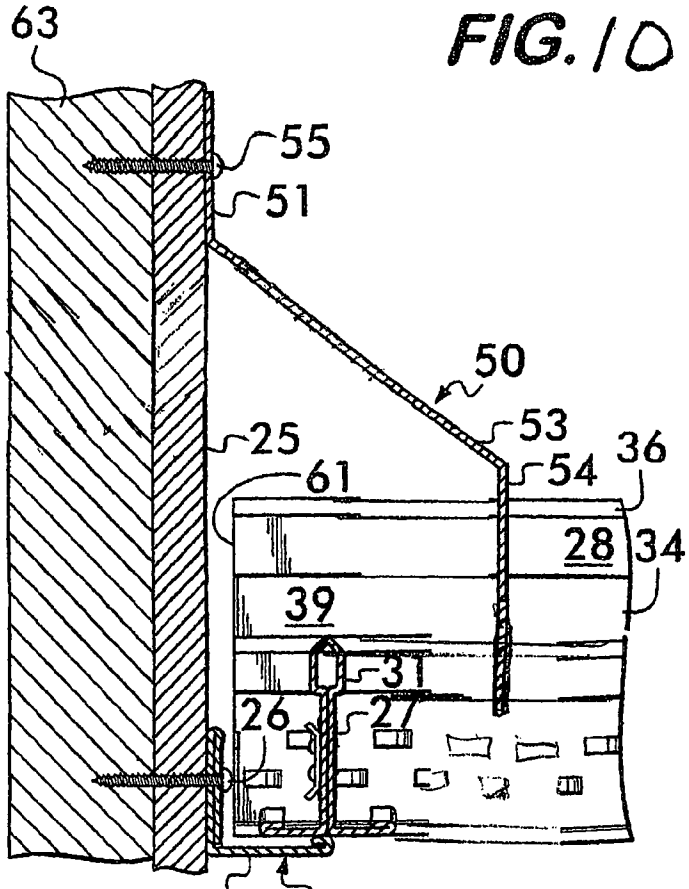
FIG. 10 is a view similar to FIG. 4, wherein the bulb of a main beam is also slidably engaged in a keyhole, along with an element of the superstructure.
Figure 12:
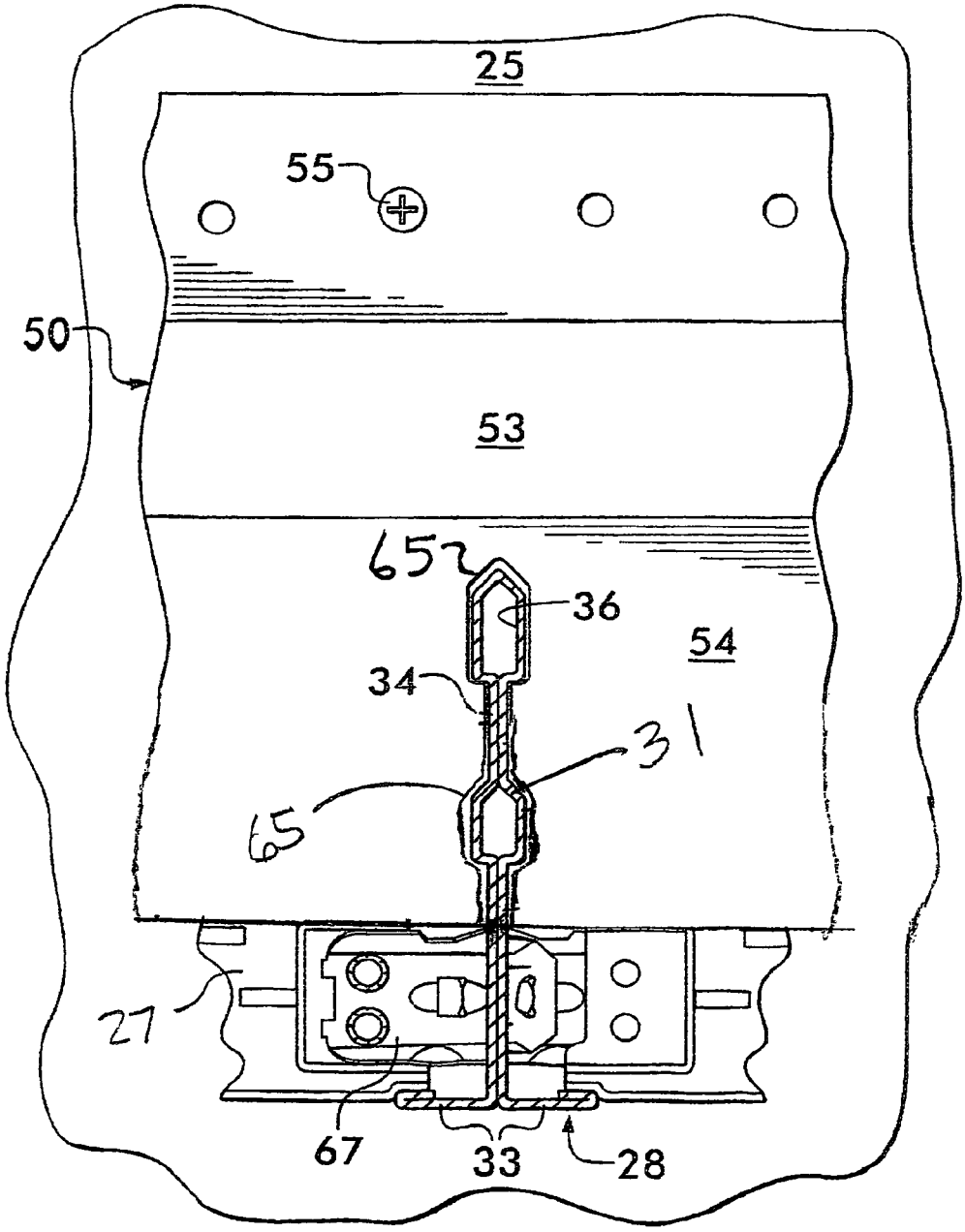
FIG. 12 is a view similar to FIG. 7, showing the structure of FIGS. 10 and 11, with an element of the superstructure, along with a bulb of a main beam, engaged in a keyhole of the lateral support bar.

In another embodiment of the invention, as seen in FIGS. 10, 11, and 12, the vertical downwardly extending segment 54 of lateral support bar 50 has keyholes 65 that also slidably receive upper bulbs 31 of main beams 28, so that additional support is given to the ceiling 10 during a seismic event.

Segment 54 is an adequate distance spaced away from slip wall 25 to permit ceiling 10 to reciprocate without interference from cross beam 27, as seen in FIGS. 10 and 11.

Ceiling During Quiet Periods

During quiet periods, the suspended ceiling 10 of the invention is supported by the ceiling grid 20, wherein main beams 28 are secured to the fixed wall 40, and rest on a wall molding 24 on slip wall 25 as done in prior art.

The lateral support bar extends over, and receives elements 34 of superstructure 30, as in the prior art, but performs no support function for the superstructure 30 in such quiet period.

Ceiling During Seismic Event

In a seismic event, the opposing fixed wall 40 and slip wall 25, shake toward and away from each other, as seen in FIGS. 4 and 5. FIG. 4 shows the walls 40 and 25, at their closest, and in FIG. 5, the walls 40 and 25 are shown the furthermost apart, wherein the shake is large enough to move the end 39 of main beam 28 off the horizontal ledge 23 of angle wall molding 24.

To the extent the beam is not shaken off angle wall molding 24, the molding 24 continues to support the end 39 of the main beams 28, and elements 34 of the superstructure 30 merely slides in keyholes 60.

If the seismic event does shake the ends 61 of main beam 28 off the horizontal ledge 23 of wall molding 24, as seen in FIG. 5, the suspended ceiling 10 continues to be supported from fixed wall 40 and slip wall 25 by superstructure 30. Superstructure 30 is slidably supported at the slip wall 25 in its engagement with the lateral support bar 50, as described above, and at the opposite fixed wall 40 from the angle wall molding 41 to which the superstructure 30 at that end of the ceiling 10, is secured.

As set forth above, the wall molding 24 continues to support the beam 28 end 61 when such end 61 is positioned above horizontal ledge 23 of molding 24.

Figure 1:
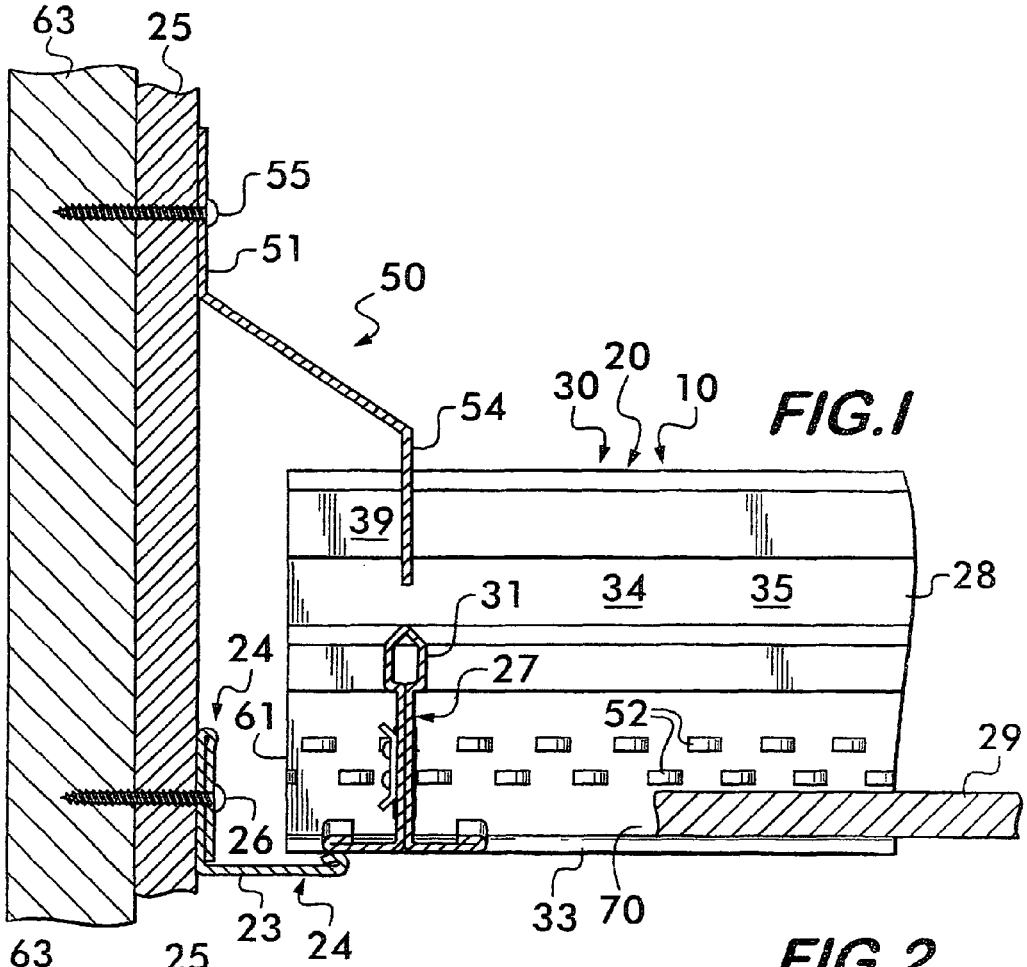
FIG. 1 is a partial side elevation section of a main beam resting on a wall molding at the slip wall, with the superstructure of the invention engaged with the lateral support bar of the invention.

When the seismic event ends, the superstructure, and grid, returns to the rest position shown in FIG. 1, wherein the end 61 of main beam 28, at the slip wall, is supported by the angle wall molding 24.

What is claimed is:

1. In a grid for a suspended panel ceiling adapted for use in seismic prone areas, having main beams, each having a web with a bulb at the top and flanges at the bottom, extending between opposing walls, with the main beams secured to a wall molding on a fixed wall at one side of the grid, and resting on a ledge of a wall molding secured to a slip wall at the opposite side of the grid;

the improvement comprising:

1. a superstructure of elements, each of which is formed on and above a main beam in the ceiling grid, and each such element having an upper web extending from each main beam and an upper bulb at the top of the upper web; and
2. a lateral support bar mounted on the slip wall
   a. extending across the ends of the elements of the superstructure, and
   b. having laterally spaced keyholes, each of which receives the upper web, the upper bulb, or both an element of the superstructure, wherein such lateral support bar is capable of slidably supporting such superstructure, and the ceiling below such superstructure, at the slip wall, as the ceiling shakes off the ledge of the wall molding secured to the slip wall during a seismic event.

2. The improvement of claim 1, wherein the laterally spaced keyholes conform in shape to a cross section of an upper bulb and upper web.

3. The improvement of claim 1, wherein the superstructure is integral with the main beams, and the bulbs of the main beams are also slidably engaged in the keyholes.

4. The improvement of claim 1, wherein the superstructure is attached to the main beams by screws.

* * * * *

UNITED STATES PATENT AND TRADEMARK OFFICE

CERTIFICATE OF CORRECTION

PATENT NO. : 8,209,931 B2
APPLICATION NO. : 12/806769
DATED : July 3, 2012
INVENTOR(S) : Brett W. Sareyka It is certified that error appears in the above-identified patent and that said Letters Patent is hereby corrected as shown below:

Claim 1

Column 5,
Line 13, after "both" and before "an", insert --,of--.

Signed and Sealed this
Second Day of October, 2012

David J. Kappos

David J. Kappos
*Director of the United States Patent and Trademark Office*